US005281507A

United States Patent [19]

Simms et al.

[11] Patent Number: 5,281,507

[45] Date of Patent: Jan. 25, 1994

[54] TREATMENT TO ENHANCE TRANSFER IN LIQUID TONER ELECTROPHOTOGRAPHY

[75] Inventors: Robert M. Simms, Beavercreek; David D. Dreyfuss, Kettering; George A. Gibson, Vandalia; Jian Wen, huber Heights, all of Ohio

[73] Assignee: AM International, Inc., Chicago, Ill.

[21] Appl. No.: 970,129

[22] Filed: Nov. 2, 1992

[51] Int. Cl.[5] ..... G03G 13/14; D06N 7/04

[52] U.S. Cl. ..... 430/126; 428/147

[58] Field of Search ..... 430/126; 428/147

[56] References Cited

U.S. PATENT DOCUMENTS 3,481,734 12/1969 Bornarth .
3,576,019 4/1971 Sweeny et al. .
3,671,493 6/1972 Lo Monaco et al. .
3,811,933 5/1974 Uffner et al. .
3,953,374 4/1976 Windhager .
4,171,417 10/1979 Dixon .
5,030,678 7/1991 Hui et al. .

*Primary Examiner*—John Kight, III
*Assistant Examiner*—T. Mosley
*Attorney, Agent, or Firm*—Tarolli, Sundheim & Covell

[57] ABSTRACT

The present invention resides in a method for transferring images from an image-bearing surface, to a moving web or sheet. The image-bearing surface is advanced in a predetermined direction, and the receptor area of the image-bearing surface is exposed to successive images. The successive images are developed using a liquid toner comprising charged pigmented particles, in a liquid hydrocarbon carrier. A porous web is transported in synchronism with movement of said image-bearing surface into position for transfer of said developed images on said receptor area successively onto said web. In one embodiment, the web is an uncoated, non-conductive porous material. The web is treated with a fluorinated or partially fluorinated hydrocarbon surfactant hold-out material in an amount effective to reduce the penetration rate of the toner carrier into the web so as to ensure that sufficient carrier is available for complete and void-free transfer. In another embodiment, the same treatment is effective to prevent the leaching of materials from coatings such as those used in the manufacture of carbonless papers.

11 Claims, 2 Drawing Sheets

TREATMENT TO ENHANCE TRANSFER IN LIQUID TONER ELECTROPHOTOGRAPHY

BACKGROUND OF THE INVENTION

1. Technical Field

The present invention relates to electrophotographic or electrographic printing or copying using a liquid toner, and more particularly, relates to improved transfer of a developed image onto a receiving web.

2. Description of the Prior Art

U.S. Pat. No. 3,953,374 discloses that a fluorocarbon can be used to achieve solvent hold-out properties in the manufacture of electrofax paper. The fluorocarbon is incorporated into an electroconductive coating applied to a paper base. The coating formulation also comprises electroconductive polymers, binders, and pigments. The fluorocarbon provides resistance to solvent penetration in the paper base during subsequent application of a zinc oxide photosensitive coating to the base, and also resistance to kerosene penetration in the later copying process using a wet toner comprised of kerosene, binders, and carbon particles.

U.S. Pat. No. 4,171,417 contains a similar disclosure to that in U.S. Pat. No. 3,953,374. Here, the process is used in the manufacture of electroconductive papers.

U.S. Pat. No. 3,811,933 discloses a coating formulation comprising certain binders and 0.05–10 weight percent fluorine containing polymer. The coating formulation imparts solvent, oil and grease resistance to a cellulosic material. This patent makes no reference to electrophotographic printing.

U.S. Pat. Nos. 5,030,678, 3,576,019, and 3,671,493 also disclose the application of fluorocarbons to paper to achieve oil repellency. None of these patents make any reference to electrophotographic printing.

SUMMARY OF THE INVENTION

The present invention resides in a method for transferring images, from an image-bearing surface, to a moving web. It will be understood by those skilled in the art that for the purposes of the present invention, the term "web" can mean a continuous long sheet of indefinite length, for instance in roll form. Alternatively, the term "web" can mean a cut sheet, of defined length, frequently provided in stacked form.

The image-bearing surface has a refreshable image receptor area or a permanent image. The image-bearing surface is advanced in a predetermined direction, and in the case of a refreshable receptor area, the receptor area of the image-bearing surface is exposed to successive images in the form of light or charge. The successive images are developed using a liquid toner comprising pigmented particles, a charge control agent, and a liquid hydrocarbon carrier.

In one embodiment of the present invention, a porous web is transported in synchronism with movement of the image-bearing surface into position for transfer of the developed images on the receptor area successively onto the web. The web is treated with a fluorinated hydrocarbon polymer or surfactant hold-out material in an amount effective to substantially reduce the penetration rate of the toner carrier into the web. The present invention prevents or reduces the development of microvoids in the transferred image.

In another embodiment of the present invention, the web may have a coating such as might be used, for example, to make carbonless paper. The web is treated with a fluorinated hydrocarbon polymer or surfactant material to prevent coating damage or leaching of materials from the paper coating.

In a preferred embodiment of the present invention, the receiving web is an uncoated, non-conductive, cellulosic material.

The present invention is particularly applicable where the web is paper having a Sheffield porosity in the range of 20–1,400 milliliters per second at a pressure of 1.5 psi with a ¾" orifice, and a Sheffield smoothness in the range of 75–400 milliliters per second at a pressure of 1.5 psi.

A preferred toner liquid carrier is a liquid hydrocarbon and a preferred fluorinated hydrocarbon is one which dramatically reduces the wettability of the web by the carrier without interfering with toner charging.

BRIEF DESCRIPTION OF THE DRAWINGS

Further features of the of the present invention will become apparent to those skilled in the art to which the present invention relates from reading the following specification with reference to the accompanying drawings, in which.

DESCRIPTION OF PREFERRED EMBODIMENTS

An electrophotographic printing machine, with which the present invention is useful, is disclosed in U.S. Pat. No. 5,043,749, assigned to the assignee of the present application. This patent is incorporated herein by reference.

The printing machine of U.S. Pat. No. 5,043,749 comprises plural printing engines. Each printing engine contains a rotatable drum having an active photoreceptor surface which is used as an image-bearing surface. Accessory apparatus is spaced around the periphery of the drum. A charging apparatus uniformly charges the photoconductor. An LED array imaging system selectively exposes and discharges the photoreceptor surface to create a digital image on the drum. Successive images are created on the photoreceptor surface as the drum rotates. The successive images are developed in a developing apparatus, using a liquid toner comprising pigmented particles, a charge control agent, and a liquid hydrocarbon carrier. The developed images are then transferred to a web by a transfer apparatus, all as disclosed in U.S. Pat. No. 5,043,749.

The liquid carrier of the toner is a non-polar liquid. The carrier has a high volume resistivity in excess of $10^9$ ohm-cm and a low dielectric constant (below 3).

The carrier is preferably an isoparaffinic hydrocarbon solvent such as those marketed by Exxon Corporation under the trademarks ISOPAR G, ISOPAR H, and ISOPAR L.

Figure 1:
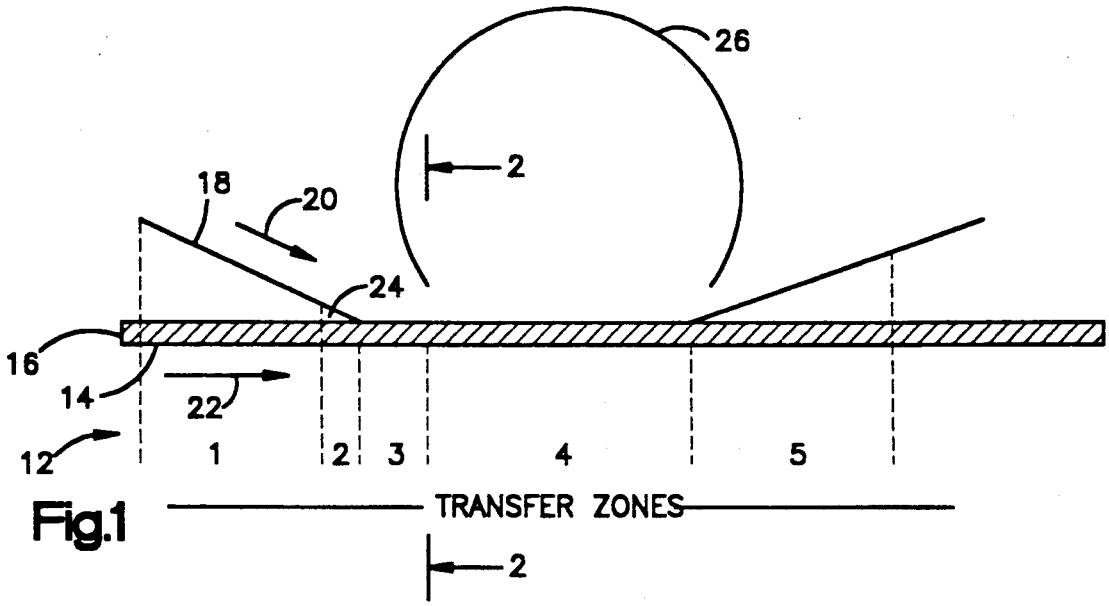
FIG. 1 is a schematic elevation view of the transfer apparatus of a printing machine of the present invention.

FIG. 1 is a schematic elevation view illustrating the transfer apparatus of the present invention. FIG. 1 illustrates a substrate 12 which has an active image-bearing surface 14. The image-bearing surface 14 carries on it a liquid toner 16. The toner 16 comprises charged pigmented particles, and a liquid hydrocarbon carrier. Idler rolls (not shown) bring a receiving web 18 into proximity with the image-bearing surface 14. The receiving web 18 and the image-bearing surface 14 are moved in synchronism with each other, in the direction of arrows 20, 22.

To describe the transfer process, it is useful to consider 5 transfer zones. In zone 1, the receiving web 18 approaches the image-bearing surface 14. In zone 5, the receiving web is pulled away from the image-bearing surface. The entrance and exit angles of the receiving web 18 and the image-bearing surface 14 are exaggerated, in FIG. 1, for the purpose of clarity.

In zone 2, the receiving web 18 and the image-bearing surface are in close enough proximity that a meniscus 24 of liquid carrier is formed between the receiving web 18 and the image-bearing surface 14. This results in some absorption of liquid carrier, from the toner 16, into the receiving web, in zone 2.

A transfer corotron 26 is positioned above the receiving web 18 in transfer zone 4. The transfer corotron 26 supplies significant charge to the receiving web 18. This charge is opposite that of the pigmented particles. This causes the pigmented particles to move or change allegiance from the image-bearing surface, in zone 4, to the receiving web 18.

The corotron 26 also applies charge to the paper in zone 3. In zone 3 and in zone 4, the absorption of carrier liquid from the toner 16 into the receiving web continues, to the end of zone 4.

Transfer occurs when the toner particles are sufficiently more attracted to the web 18 so that they stay with the web in zone 5 rather than remaining with the image-bearing surface 14.

Figure 2:
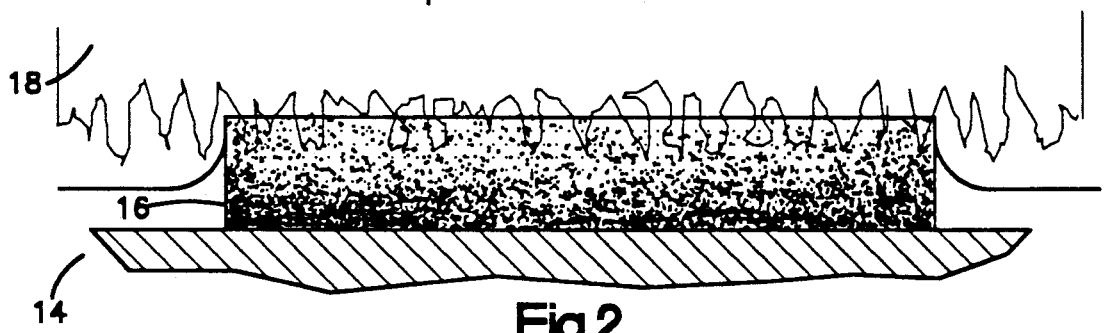
FIG. 2 is a schematic, enlarged, sectional view taken along line 2—2 of FIG. 1, showing transfer of an image from an image-bearing surface to a receiving web.

This can be further visualized by reference to FIG. 2. The section view of FIG. 2 is taken at an early stage in the transfer process of FIG. 1. In the drawing of FIG. 2, the receiving web 18 has a thickness of about 60 microns, and a surface roughness of about 10 microns. The thickness of the toner 16, or developed image, on the image-bearing surface, is about 25 microns.

In order to have complete and uniform transfer of a liquid toner, it has been found necessary to have sufficient liquid at the surface of the web 18 to fill the gap between the image-bearing surface 14 and the web. The electrostatic forces on the particles, although sufficient to cause movement of the particles within the liquid carrier of the toner 16, are insufficient to allow the toner particles to break the surface tension of the liquid carrier and move through air to the web. Thus, the toner particles cannot escape from the liquid carrier, and deposit onto the web 18, unless an interface of the carrier exists with the web 18. Transfer efficiency may be near 100% but some toner particles may divert around air spaces resulting in "microvoids" on the web 18.

While the web 18 is in contact with the image-bearing surface 14 in transfer zones 2, 3 and 4, it continuously absorbs liquid carrier. In order to ensure that sufficient carrier liquid is present through transfer zone 4, one or more of three conditions must be met: (1) the carrier penetration rate into the paper must be sufficiently low, (2) the length of zone 4 must be sufficiently short, or (3) a sufficient excess of carrier- must be available. All three of these conditions can be shown experimentally to result in substantially void-free transfer. Condition 2 is limited by the need to maintain sufficient length to allow the application of sufficient charge. Condition 3 is limited by the need to have the image be a high enough viscosity, or weight percent solids, to prevent image disruption by the fluid turbulence existing in Zone 2. Condition 3 is further limited by the economic need to minimize the amount of carrier liquid in the web 18 after transfer. The present invention is thus designed to address Condition 1 for those webs which do not naturally have a sufficiently low carrier penetration rate.

It has been found that factors involved in the carrier penetration rate are the porosity of the web 18 and its smoothness. High porosity can cause increased wicking of liquid carrier into the web 18. High surface roughness provides a large air volume at the surface which must be filled to fully wet the web 18.

The porosity and smoothness of a web can be determined using the Variable Area Porosimeter® and Paper Smoothness Gauge made by the Sheffield Measurement Division of Testing Machines, Inc. To measure porosity, a sample is sandwiched between a pair of rubber plates with a known circular orifice (0.75 inch diameter in this instance). Air pressure of 1.5 psi is applied to one side of the paper, and the leakage in milliliters per second through the paper is measured.

A similar method is used to measure smoothness. A sample is placed against a smooth glass plate, and a pair of concentric polished rings are pressed, with a known force, against the top surface. Air at a known pressure, in this instance 1.5 psi, is applied to the space between the rings, and a flow meter reports the leakage rate. Sheffield "smoothness numbers" are the leakage in milliliters per second.

The numbers that are obtained are not exact. Measurements by different people on different samples often give somewhat different results. However, the numbers which are obtained and given in this application are representative of the smoothness and porosity of the papers or web samples which were tested.

The amount of wicking into and onto a web is characterized herein as the carrier penetration rate. The carrier penetration rate is expressed in terms of milligrams of penetration of carrier per square centimeter per second.

The carrier penetration rate is determined by measuring the time it takes for a known mass of carrier to be absorbed by the web.

Figure 3:
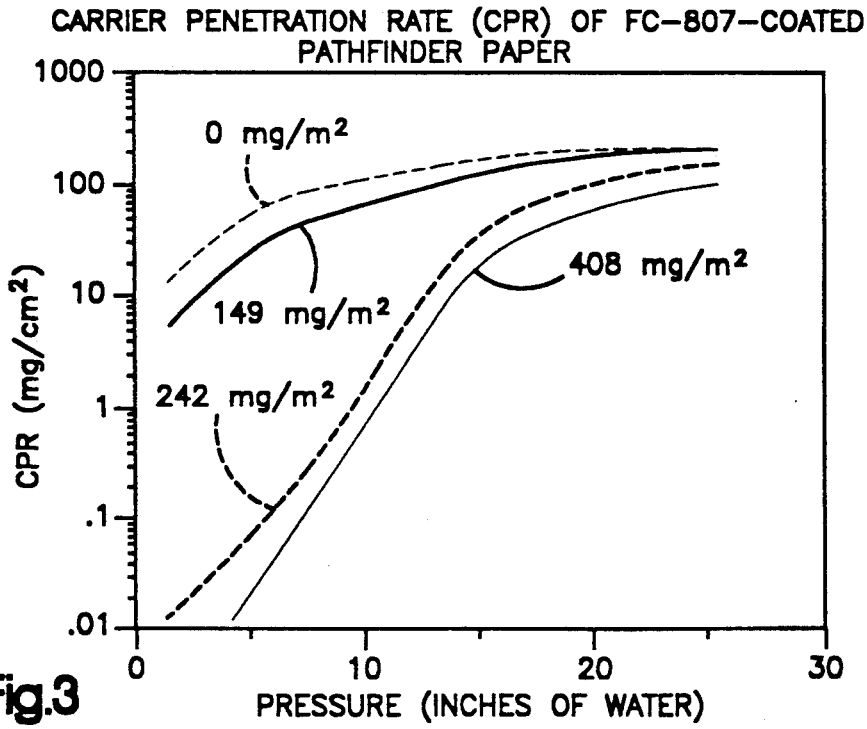
FIG. 3 is a graph plotting carrier penetration rate against applied pressure for various levels of coating of a holdout material on a representative paper with which the present invention is applicable.

FIG. 3 shows the carrier penetration rate (CPR) for samples of Lyon Falls Pathfinder paper coated with varying amounts of a fluorinated hydrocarbon resin or surfactant marketed by the 3M Company as FC-807. The experiment was conducted by drawing a partial vacuum on the underside of a sample of paper. A reservoir of carrier (Isopar H marketed by Exxon Corporation) was placed above the sample, and the rate at which the carrier passed through the paper was recorded. FIG. 3 shows the CPR versus the applied pressure difference across the sample. Note the strong effect of pressure. Very low coating densities are sufficient to dramatically alter the penetration rate at low pressures. Progressively higher coating densities are required at higher pressures until a point is reached above which the holdout properties of FC-807 are largely ineffective at reducing the CPR.

The following Example illustrates the present invention and the reduction of microvoids that can be achieved by applying a carrier hold-out material to the receiving web, prior to image transfer. The receiving web may be paper, cardboard, or cloth material made from synthetic or natural material.

EXAMPLE 1

Samples of two papers, Lyons Falls Pathfinder paper and Pinehurst Smooth Offset paper, were coated with varying amounts of FC-807, a fluorinated surfactant marketed by the 3M Company. The coated papers were then tested for microvoids when exposed to image transfer. The transfer was carried out in the press of U.S. Pat. No. 5,043,749, marketed by the assignee of the present application, and operated at a speed of about 100 feet per minute.

The FC-807 was applied in a solvent solution to the papers at amounts varying from 0 to 500 milligrams of solids per square meter.

Figure 4:
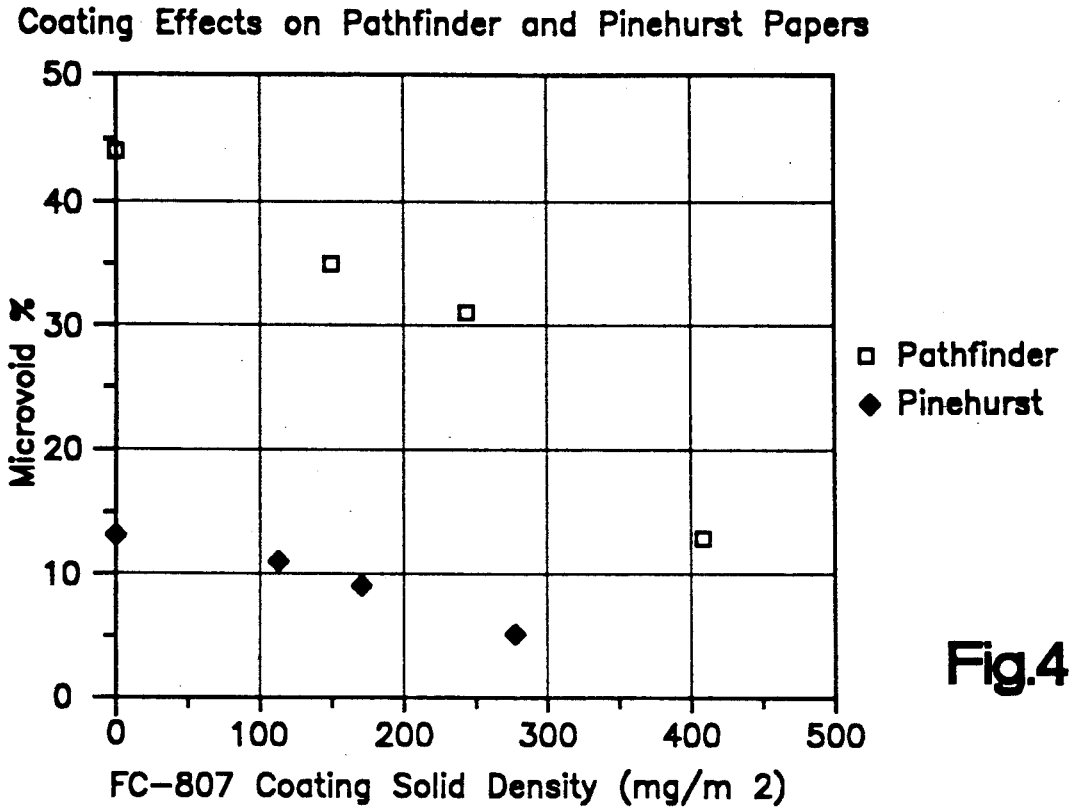
FIG. 4 is a graph comparing percent microvoids against coating density, of a carrier hold-out coating, for two representative papers.

In order to quantify the reduction in microvoids, the prints were analyzed to determine the "percent microvoids". The percent microvoids is determined by transmissive illumination through a microscope at a scale of 19 μm per pixel. A sample of an image is captured in a computer-based image analysis system. The void measurement is based on the fraction of the sample area (250×200 pixels) which is brighter than a threshold light level. The threshold level in the measurements of FIG. 3 was 150 where white paper areas were set to a light level of 250. The results are plotted in FIG. 4. FIG. 4 shows that with both papers, the percent microvoids dramatically decreased with increased coating density of FC-807. The percent microvoids for the very rough, porous pathfinder paper was reduced to less than 15% by -the application of 400 milligrams per square meter of FC-807. FIG. 4 also shows that even with the smoother, less porous Pinehurst paper, the percent microvoids can be reduced to less than half by the application of FC-807 to the receiving web prior to image transfer.

Figure 5:
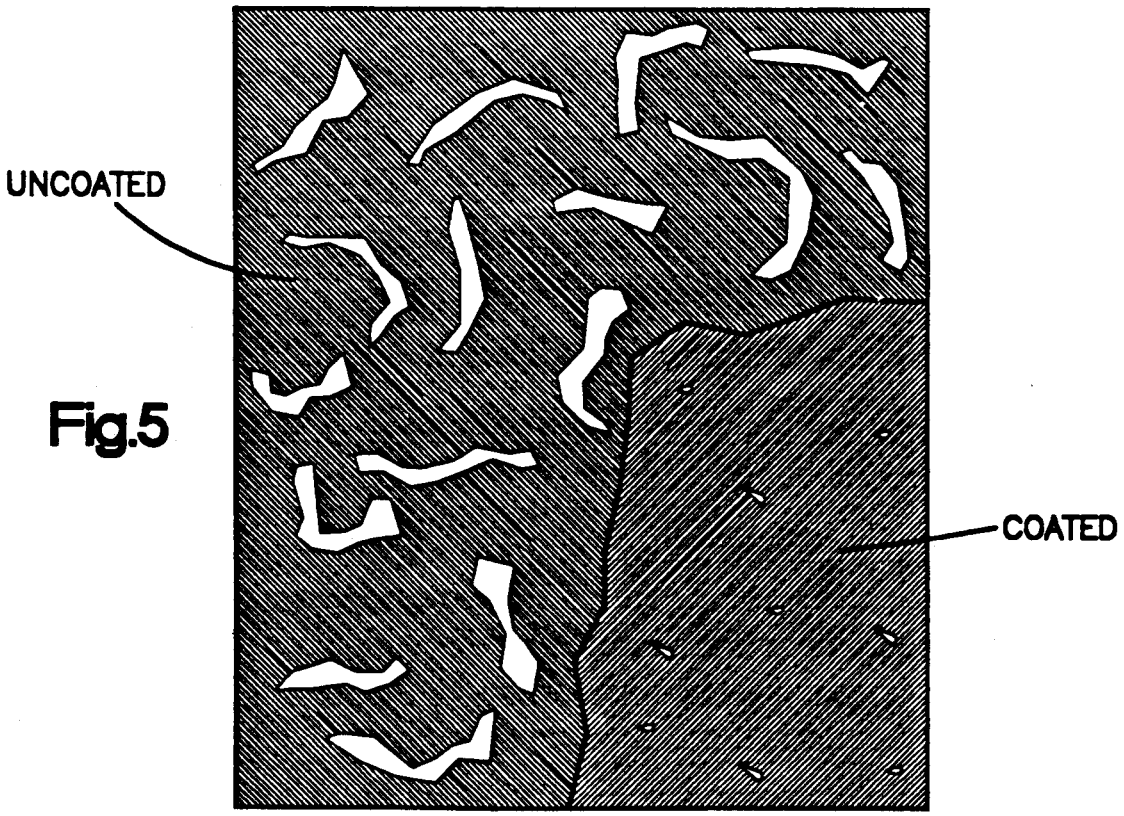
FIG. 5 is a drawing visually illustrating the effect of coating representative papers with a carrier hold-out material in accordance with the present invention, and showing reduction in percent microvoids.

FIG. 5 illustrates visually the effect of coating a receiving web with carrier hold-out material. The web used in preparing the sample of FIG. 5 was the Pathfinder paper. The coated region of the sample was coated with 400 milligrams of solids of FC-807 per square meter. The coated region appears, in FIG. 5, substantially more dense, indicative of fewer microvoids.

Liquid toners useful in the process of the present invention are disclosed in U.S. Pat. Nos. 4,891,286 and 4,897,332, assigned to the assignee of the present application. The disclosures of these two patents are incorporated by reference herein. U.S. Pat. No. 4,794,651 also discloses toner compositions useful in the practice of the present invention. The disclosure of U.S. Pat. No. 4,794,651 is also incorporated by reference herein.

Representative examples of hold-out coating materials which give the desired effect include materials sold by The 3M Company under the trademarks SCOTCHGARD and SCOTCH BAN with the designations FC-100, FC-431, FC-807, and FX-845. These materials are fully fluorinated, cationic or amphoteric surfactants.

FC-100, FC-431 and FC-807 are methanol soluble and can be applied by any suitable technique such as roll coating, spraying, or other suitable application means, and air dried. FX-845 is water soluble and must be heat set to achieve carrier hold-out. This material can also be applied by roll coating, spraying or other suitable application means.

Similar hold-out materials as those made by The 3M Company are made by E. I. du Pont de Nemours and Co. and marketed under the trademark "ZONYL".

It will be understood by those skilled in the art that the solvent hold-out materials may be applied during paper manufacture, for instance by mixing with the sizing solution in the manufacture of the paper. Alternatively, they may be applied by common liquid coating methods such as spraying, dipping, the use of a doctor blade, and roll coating. Many common printing techniques, such as ink jet, offset, silk screen, stamping, and gravure, can be used to selectively coat a web. These techniques could be used to apply the hold-out coating in applications where the hold-out coating is only required in selected small areas, for instance, headlines, figures, and the like, and the cost of the hold-out coating material- is of concern.

It will be understood by those skilled in the art that the hold-out coating material selected must be compatible with the charge direction system used for the toner.

EXAMPLE 2

The hold-out ability of fluorocarbon coatings is also useful to prevent leaching of material from paper coatings into the working toner bath. Liquid toner non-impact printers have an advantage for the printing of carbonless paper, as they do not use pressure to fuse the images. Carbonless paper typically has a coating which includes microcapsules. Pressure can cause the microcapsules of the carbonless paper to rupture causing discoloration of the paper.

It was found that some carbonless paper discolored when passed through a non-impact printer. The discoloration was traced to color formation in the absence of mechanical damage to the microcapsules. It is believed likely that the color formation occurred when the carrier in the toner caused the microcapsules to lose their color forming material, or in essence leak.

It was found in accordance with the present invention that overcoating of carbonless paper coatings (for example, papers marketed by Appleton Paper Co.) with a carrier hold-out material, for instance FC-807, eliminated the color formation, even when the paper was placed in the carrier for up to one-half hour. It is believed that the application of the carrier hold-out material prevents the capsules in the carbonless paper from being wet effectively with the toner carrier.

Alternate methods of application for the carrier hold-out material can be envisioned. In addition to the methods cited in Example 1, the holdout material could be mixed with the microcapsules prior to application to the paper.

It will be understood by those skilled in the art that similar advantages may be obtained for any other coatings or inks found to be sensitive to the liquid carrier used in liquid toner printing or copying.

A significant advantage of the present invention is that it permits the use of liquid toner non-impact printers with a much wider variety of receiving webs than heretofore available.

From the above description of the invention, those skilled in the art will perceive improvements, changes and modifications. Such improvements, changes and modifications within the skill of the art are intended to be covered by the appended claims.

Having described the invention, the following is claimed:

1. A method for transferring images developed from a an electrostatic image-bearing surface to a moving web or sheet, wherein said image is developed from a toner dispersed in a non-polar liquid which has a high volume resistivity and a low-dielectric constant, and comprising the steps of:

(a) transporting a receiving web in synchronism with movement of said image-bearing surface into position for transfer of a developed image successively onto said web;

(b) said receiving web being a material coated with a fluorinated or partially fluorinated hydrocarbon resin or surfactant; and (c) transferring the image from said image-bearing surface to the web.

2. The method of claim 1 wherein the web is an absorbent material, and said surfactant is present in an effective amount to reduce the formation of voids in the image transfer.

3. The method of claim 2 wherein said receiving web is paper, cardboard, or cloth fabric made from natural or synthetic materials.

4. The method of claim 2 wherein said web has a Sheffield porosity over 20 milliliters per second at a pressure of 1.5 psi and an orifice diameter of 0.75 inches.

5. The method of claim 2 wherein said web has a Sheffield smoothness over 75 milliliters per second at a pressure of 1.5 psi.

6. The method of claim 1 wherein said web includes a coating which is sensitive to exposure to said liquid.

7. The method of claim 6 wherein said coating consists of microcapsules containing a substance leachable from said microcapsules by said liquid.

8. The method of claim 7 wherein said microcapsules are part of a carbonless paper.

9. The method of claim 2 or 6 wherein said liquid is an isoparraffinic hydrocarbon solvent.

10. The method of claim 2 or 6 wherein said surfactant is a fluorinated surfactant.

11. The method of claim 10 wherein said surfactant is a cationic or amphoteric surfactant.

* * * * *